US005379569A

United States Patent [19]

Mueller

[11] Patent Number: 5,379,569

[45] Date of Patent: Jan. 10, 1995

[54] METHOD AND APPARATUS FOR PROTECTING A FOOD

[76] Inventor: Martin Mueller, 4929 E. Lake Shore Dr., Wonder Lake, Ill. 60097

[21] Appl. No.: 86,316

[22] Filed: Jul. 6, 1993

[51] Int. Cl.[6] ..... B65B 35/50; B65B 61/22

[52] U.S. Cl. ..... 53/397; 53/142; 53/157; 53/445; 53/447

[58] Field of Search ..... 53/397, 447, 445, 157, 53/156, 155, 154, 142, 594, 540, 531, 238; 426/139, 420

[56] References Cited

U.S. PATENT DOCUMENTS

| | | | |
|---|---|---|---|
| 2,303,420 | 12/1942 | Amberg et al. | 53/397 |
| 2,886,927 | 5/1959 | Fisk | 53/445 |
| 3,261,500 | 7/1966 | McGlynn | 53/447 X |
| 3,289,385 | 12/1966 | Syverson et al. | 53/445 X |
| 3,526,075 | 9/1970 | Mueller et al. | 53/447 |
| 3,927,506 | 12/1975 | Abd-Alla | 53/330 X |
| 4,233,325 | 11/1980 | Slangan et al. | 426/107 |
| 4,289,791 | 9/1981 | Weinstein | 426/139 |
| 4,313,965 | 2/1982 | Weinstein | 426/139 |
| 4,529,470 | 7/1985 | Weinstein | 156/423 |
| 4,720,037 | 1/1988 | Alpert | 229/1.5 H |
| 5,228,267 | 7/1993 | Blankenship et al. | 53/142 X |

*Primary Examiner*—James F. Coan

*Attorney, Agent, or Firm*—Mathew R. P. Perrone, Jr.

[57] ABSTRACT

A plurality of ice cream cones can have a removable protective covering applied thereto. An conveyor belt moves each cone of a plurality of conveying cones to a predetermined point. Prior to reaching the predetermined point, an edible adhesive is applied to the base of each cone. At the predetermined point, paper is applied to the base of the cone and adhered thereto. The cones are then stacked and packed for transport.

9 Claims, 2 Drawing Sheets

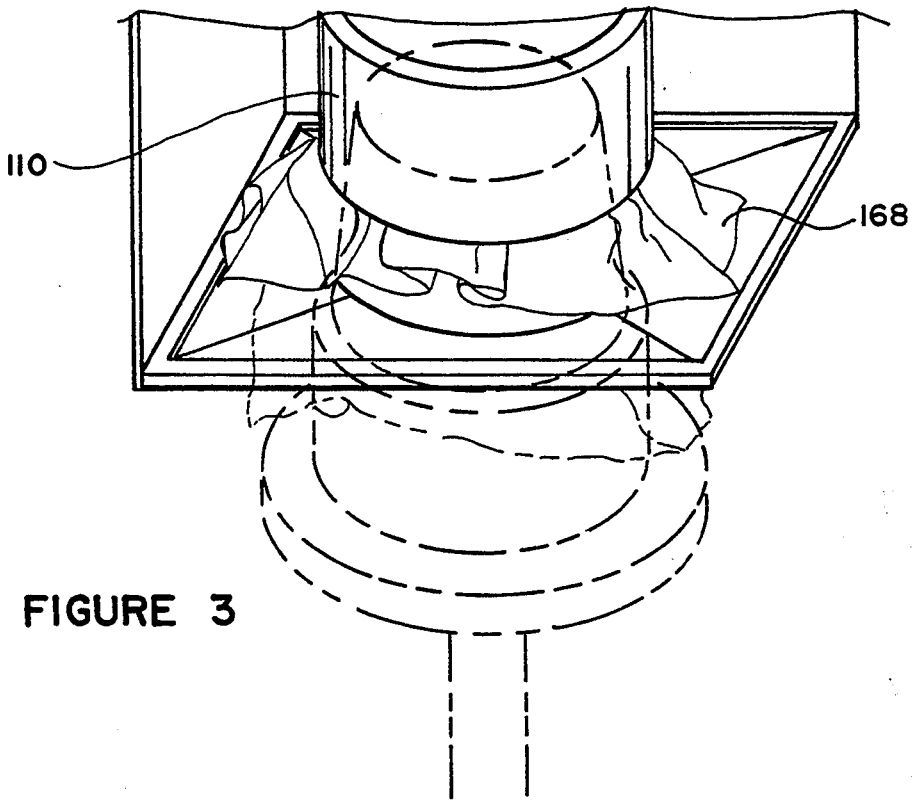
FIGURE 3
FIGURE 2
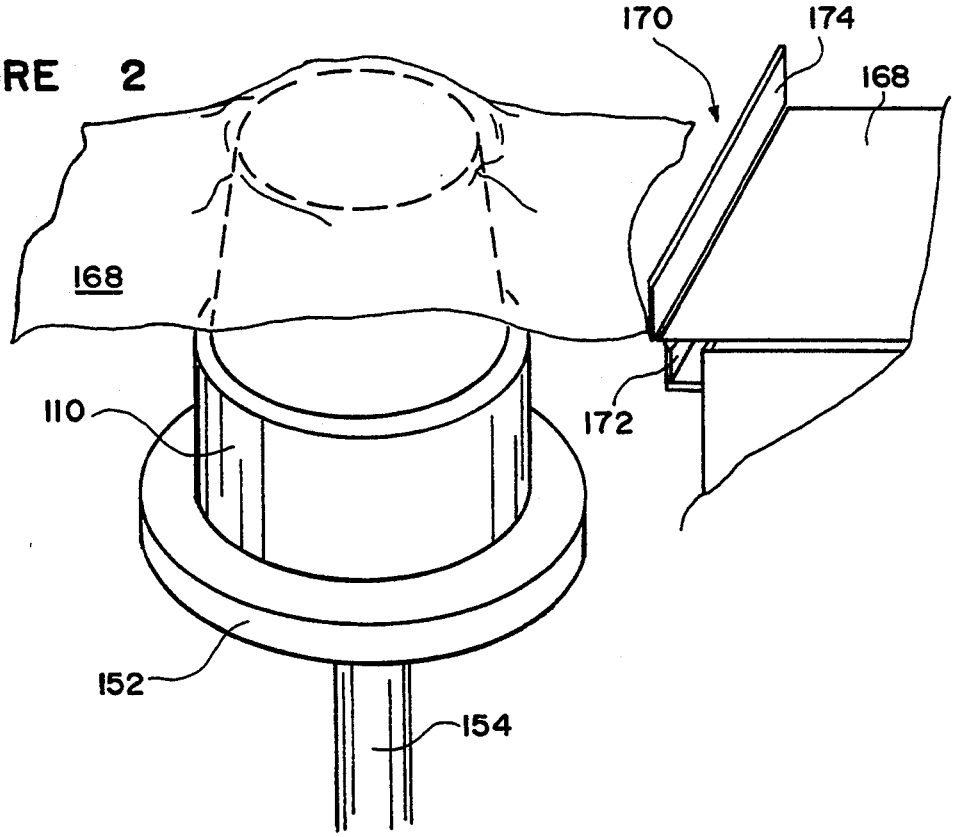

METHOD AND APPARATUS FOR PROTECTING A FOOD

This invention relates to a method and apparatus for protecting an ice cream cone and similar food items, and more particularly to a method and apparatus for applying a protective device to the ice cream cone and similar food items so that only the final consumer of the ice cream cone touches the actual cone.

BACKGROUND OF THE INVENTION

With the awareness of the public regarding contaminated foods, the requirements for sanitation are greater than ever before. The requirements for sanitation these days are so extreme, that there is a even a substantial amount of interference with the enjoyment of the ever popular ice cream cone.

Customarily, edible containers known as cones are manufactured, nested or stacked one within another, packaged, and shipped to an end user. Each cone is removed from the package one at a time and is sold by the end uses to a consumer. Customarily there is no cover on the cone. So a cone can come into direct skin contact with someone other than the end consumer.

Since the development of the ice cream cone at the St. Louis World's Fair about one hundred years ago, an ice cream cone is known to produce great enjoyment. An ice cream store can have many varieties of ice cream and hand pack the desired flavor into the desired cone. It is difficult to accomplish this function under the extreme sanitary conditions of today.

However, sanitation and cleanliness are even more important in the food industry. It is difficult to avoid direct skin to food contact in an ice cream cone. With the widespread fear of infectious disease, the enjoyment of an ice cream cone can be substantially reduced.

It is known to provide some protection devices to an ice cream cone. Most of these known protection devices are either inefficient or too expensive. For example, merely wrapping a paper around the ice cream cone is an inefficient way of protecting the ice cream cone. Not only is it difficult to provide an efficient wrapping of the cone, direct skin to cone contact cannot be easily avoided as the paper is wrapped therearound.

Providing a cup in which to insert the ice cream cone for protection or sanitation adds to the expense of the cone. A cup is relatively expensive to manufacture. Then a separate step of inserting the cone in the cup is required. These factors complicate the serving of the cone, while adding substantially to the expense thereof.

Furthermore, a cone containing ice cream is known to leak. When a cone leaks, at least the person's hands become soiled or sticky. Such stickiness is uncomfortable at best and damaging to a person's clothes at worst.

Also, it is advisable to have a cleaning device available for solving this problem. If the cone can be protected while at the same time providing this cleaning device, a great advantage is obtained.

SUMMARY OF THE INVENTION

Among the many objectives of this invention is the provision of an edible cone capable of containing ice cream or similar food with a protective covering removably adhered to the cone.

A further objective of this invention is to provide an edible cone having a protective cover adhered thereto.

A still further objective of this invention is to provide an edible cone with a removable protective cover adhered thereto.

Yet a further objective of this invention is to provide an nestable or stackable edible cone with a protective cover.

Also an objective of this invention is to provide a method for placing a protective cover on a cone.

Another objective of this invention is to provide a method removably applying a protective cover to an edible cone.

Yet another objective of this invention is to provide a method for stacking a plurality of covered cones.

Still another objective of this invention is to provide a method for forming a cover for a cone.

These and other objectives of the invention (which other objectives become clear by consideration of the specification, claims and drawings as a whole) are met by providing an apparatus for conveying cones to a predetermined point. Prior to reaching the predetermined point, an edible adhesive is applied to the base of each cone. At the predetermined point, paper is a applied to the base of the cone and adhered thereto. The cones are then stacked and packed for transport.

BRIEF DESCRIPTION OF THE DRAWINGS

FIG. 2 depicts a perspective view of a cone 110 having paper cover 120 applied thereto.

FIG. 3 depicts a perspective view of a cone 110 having paper cover 120 applied thereto and stacked with a second cone 110.

Throughout the figures of the drawings, where the same part appears in more than one figure of the drawings, the same number is applied thereto.

DESCRIPTION OF THE PREFERRED EMBODIMENTS

Figure 1:
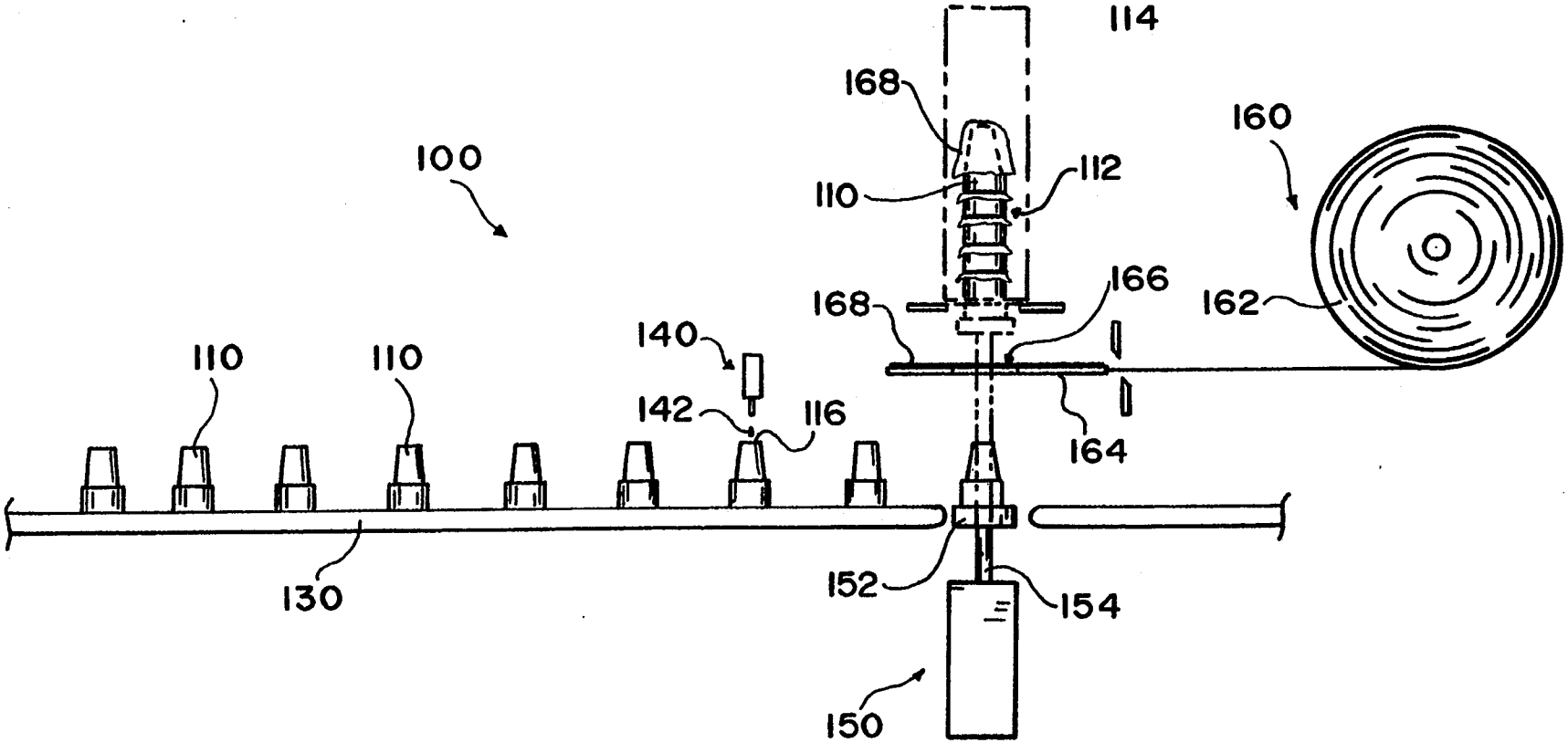
FIG. 1 depicts a side view of the cone stacking apparatus 100 of this invention.

Assuming that the cone is formed, the cones are placed on an apparatus capable of moving each cone to the same specified position. At this point, each cone receives a paper sheet. Just before each cone reaches the specified point of paper application thereto, an edible adhesive is applied, preferably to the base of the cone. Clearly the cones are exposed to the adhesive. Preferably, the cones are conveyed upside down.

A plurality of ice cream cones can have a removable protective covering applied thereto. An apparatus for conveying cones passes each cone to an adhesive applicator. At that point, an edible adhesive is applied to the base of each cone. At a predetermined point, paper is applied to the base of the cone and adhered thereto by the adhesive. The cones are then stacked and packed for transport.

After the eatable adhesive is applied to the base of the cone, paper is taken from the paper source and placed over the base of the cones. A ramming device or other stacking device then forces each cone into a stacking assembly and a package. The pressure of the ram adheres the paper to the adhesive spot on the base of the cone and wraps the rest of the paper around the side of the cone.

As the cones are removed from the packaging, the paper is available to permit gripping of the cone. The paper prevents contact of the cones by a human hand and permits the consumer of the cone to avoid drips while at the same time providing a paper with which the hands may be cleaned after the cone is consumed. In this fashion a substantial advantage is obtained over the standard cone procedures.

Referring now to FIG. 1, prepared cones 110 suitable for holding ice cream are provided to cone stacking apparatus 100. Cone stacking apparatus 100 includes a conveyor belt 130. The cone 110 on conveyor belt 130 passes an adhesive dispenser 140. At that point the adhesive dispenser 140 places a spot of edible adhesive 142 on the base 116 of the cone 110.

The thus adhesive spotted cone 110 passes then to the plunger assembly 150. The plunger assembly 150 includes a platform 152 for receiving the cone and an arm 154 for moving the platform 152 in preferably an upward direction toward a container 114.

The plunger assembly 150, conveyor belt 130 and container 114 are powered in a standard fashion. Once the key features and devices described are assembled in the manner described herein, the appropriate completion steps become clear.

Situated above the platform 152 is a paper assembly 160. Paper assembly 160 includes a roll of paper 162 which passes to a paper support 164. The paper support 164 holds the sheet of paper. Paper support 164 includes a cone aperture 166 of sufficient size to permit the cone to pass therethrough. As the cone passes through the cone aperture 166, a paper sheet 168 adheres to the adhesive spot 142 and proceeds into the container 114.

As subsequent cones with paper sheet 168 adhered thereto are pushed into container 114, the nesting capability of the cones 110 forces the paper sheet 168 therearound. The spot of edible adhesive 142 holds the paper sheet 168 on the cone 110 in the proper fashion.

Referring now to FIG. 2, platform 152 and arm 154 are depicted. At least, arm 154 is depicted partially. Also, paper roll 162 is depicted partially. As can be seen, between paper roll 162 and platform 152 is a cutting assembly 170. Cutting assembly 170 has a lower blade 172 and an upper blade 174, which combine to cut paper sheet 168 from paper roll 162.

As the cone 110 is moved in an upward direction toward the paper sheet 168, the paper sheet 168 adheres to the cone at adhesive point 142 and is pushed into the container 114. With repeat of this procedure, a stack 112 of cones 110 is formed with the paper sheet 168 adhered thereto and wrapped therearound.

As the cone 110 comes out of the container contact is made substantially only with the paper sheet 168. As the cone 110 is filled by the server, contact with the cone 110 in minimized. The consumer of the cone 110 may remove the paper sheet 168 as the cone 110 is consumed.

The paper sheet 168 may also serve, both as a hand wipe after the cone 110 and contents thereof are consumed and a device for preventing drips from the cone 110 down to the hands of the person. The paper sheet 168 may also conserve and reduce waste of a cone 110, because a cone 110 with minor cracks is still useable due to the protection provided by the paper sheet 168. Accordingly, this apparatus 100, by applying the paper sheet 168 increases the utility and reduces the waste of the cones 110.

Referring now to FIG. 3, it may be seen how the paper sheet 168 goes around the sides of the cone 110. The adhesive spot 142 holds the paper sheet 168 in position as the stack 112 is formed. The forming of the stack 112 forces the paper sheet 168 to wrap around the cone 110.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A method for protecting an ice cream cone comprising:

a) providing a plurality of ice cream cones;
b) applying an adhesive to a base of each cone in the plurality of ice cream cones;
c) providing paper supply;
d) coordinating the paper supply and the cone to arrive at a predetermined point;
e) applying a sheet of paper to the adhesive;
f) nesting a first cone within a second cone after the paper has been applied thereto to form a paper protected cone; and
e) recovering the paper protected cone.

2. The method of claim 1 further comprising:

a) cutting a piece of paper from the paper supply the piece of paper being of a sufficient size to protect a base and a side of the cone; and
b) stacking the cones in a nestable fashion, thereby applying pressure to adhere the paper to the cone using the adhesive and providing the protective cover for the cone.

3. An apparatus for protecting a cone comprising:

a) a conveying means for transporting the ice cream cones;
b) a device for applying an edible adhesive to a base of the cones while the cones are being conveyed;
c) a means for applying paper to the adhesive spot on the cone;
d) a means for nesting a plurality of the cones to form a nested cone assembly to thereby fold the paper around the cone;
e) a packaging means to receive the nested cones;
f) the conveying means being a food safe conveyor belt; and
g) the conveyor belt transporting the cones to a predetermined point adjacent to the device for applying adhesive so that the base of each cone receives a spot of the adhesive.

4. The apparatus of claim 3 further comprising:

a) the means for applying paper to the adhesive spot including a paper supply, a cutting assembly and a transport means;
b) the paper supply and cutting assembly cooperating to form a paper sheet; and
c) the transport means cooperating with the paper sheet to position the paper sheet over the cone.

5. The apparatus of claim 3 further comprising:

a) the means for nesting the cones including a reciprocating assembly to move the cone into the paper sheet;
b) the reciprocating assembly forming causing contact between the adhesive spot and the paper sheet;

c) the reciprocating assembly further forming the nested cone assembly and thereby folding the paper sheet around the cone; and d) a packaging means to receive the nested cones from the reciprocating assembly.

6. The apparatus of claim 5 further comprising:

a) the means for applying paper to the adhesive spot including a paper supply, a cutting assembly and a transpot means;

b) the paper supply and cutting assembly cooperating to form a paper sheet; and c) the transport means cooperating with the paper sheet to position the paper sheet over the cone.

7. The apparatus of claim 6 further comprising:

a) the means for nesting the cones including a reciprocating assembly to move the cone into the paper sheet;

b) the reciprocating assembly causing contact between the adhesive spot and the paper sheet;

c) the reciprocating assembly forming causing contact between the adhesive spot and the paper sheet;

d) the reciprocating assembly further forming the nested cone assembly and thereby folding the paper sheet around the cone; and e) a packaging means to receive the nested cones from the reciprocating assembly.

8. The apparatus of claim 4 further comprising:

a) the means for nesting the cones including a reciprocating assembly to move the cone into the paper sheet;

b) the reciprocating assembly causing contact between the adhesive spot and the paper sheet;

c) the reciprocating assembly forming causing contact between the adhesive spot and the paper sheet;

d) the reciprocating assembly further forming the nested cone assembly and thereby folding the paper sheet around the cone; and e) a packaging means to receive the nested cones from the reciprocating assembly.

9. A method of applying a protective covering to a cone, comprising:

a) providing a supply of cones;

b) providing a paper supply;

c) coordinating the paper supply and the cone supply to arrive at a predetermined point;

d) cutting a piece of paper from the paper supply the piece of paper being sufficient to sufficiently protect a base of the cone; and e) stacking the cones in a nestable fashion, thereby applying pressure to adhere the paper to the cone using the adhesive and providing the protective cover for the cone.

* * * * *